US005986408A

United States Patent [19]

Langeslag et al.

[11] Patent Number: 5,986,408

[45] Date of Patent: Nov. 16, 1999

[54] DISCHARGE LAMP WITH HEATING ELECTRODE CIRCUIT

[75] Inventors: Wilhelmus H. M. Langeslag, Eindhoven; Paulus P. B. Arts, Oss, both of Netherlands

[73] Assignee: U.S. Philips Corporation, New York, N.Y.

[21] Appl. No.: 09/282,328

[22] Filed: Mar. 31, 1999

[30] Foreign Application Priority Data

Apr. 2, 1998 [EP] European Pat. Off. ..... 98201047

[51] Int. Cl.[6] ..... H05B 37/02

[52] U.S. Cl. ..... 315/94; 315/105; 315/209 R

[58] Field of Search ..... 315/DIG. 5, 209 R, 315/224, 225, 276, 94, 291, 307, 308, 219, 105, 106

[56] References Cited

FOREIGN PATENT DOCUMENTS

WO9719578 5/1997 European Pat. Off. .

*Primary Examiner*—David H. Vu
*Attorney, Agent, or Firm*—Bernard Franzblau

[57] ABSTRACT

The invention relates to a circuit arrangement for operating a discharge lamp with a high frequency current comprising a power feedback circuit and an electrode preheater. The circuit arrangement comprises an antiboost switch for disabling the power feedback circuit before the lamp has ignited and enabling the power feedback circuit after the lamp has ignited. In accordance with the invention the antiboost switch is also used to enable the electrode preheater before the lamp has ignited and to disable the electrode preheater after the lamp has ignited.

20 Claims, 3 Drawing Sheets

DISCHARGE LAMP WITH HEATING ELECTRODE CIRCUIT

BACKGROUND OF THE INVENTION

The invention relates to a circuit arrangement for operating a discharge lamp with a high frequency current comprising

- input terminals for connection to a source of low frequency supply voltage,
- rectifier means coupled to said input terminals for rectifying said low frequency supply voltage,
- a first circuit comprising a series arrangement of first unidirectional means, second unidirectional means and first capacitive means, said first circuit being coupled to a first output terminal N3 of said rectifier means and a second output terminal N5 of said rectifier means,
- inverter means coupled to said first capacitive means for generating the high frequency current,
- a load circuit comprising inductive means, second capacitive means and terminals for lamp connection, said load circuit being coupled to said inverter means and to a terminal N7 between the first unidirectional means and the second unidirectional means,
- a second circuit comprising an antiboost switching element S and shunting at least one of the first and second unidirectional means, a control electrode of said switching element being coupled to a control circuit for rendering the switching element conductive and non-conductive,
- preheating means for heating at least one of the electrodes of the discharge lamp comprising a first secondary winding, said first secondary winding during operation being part of a series arrangement shunting a first lamp electrode and being magnetically coupled to the inductive means comprised in the load circuit.

Such a circuit arrangement is known from WO 97/19578. The known circuit arrangement is very suitable to be powered from a regular mains supply generating e.g. a supply voltage having an r.m.s. voltage of 230 Volt and a frequency of 50 Hz. Because of the power feedback that is realized by the load circuit and the first and second diode, a relatively high power factor is realized with comparatively simple means. The circuit arrangement is so dimensioned that during stationary lamp operation there exists a balance between the amount of power fed back and the amount of power consumed by the lamp. Before the lamp is ignited, however, the lamp does not consume any power which can lead to the first capacitive means being charged to such a high voltage that part of the circuit arrangement, e.g. the inverter means, could be damaged. To prevent this, the circuit arrangement is equipped with the second circuit. In the known circuit arrangement the control circuit that is comprised in the second circuit monitors the voltage over the first capacitive means. If this voltage becomes higher than a first predetermined value, the control circuit renders the antiboost switching element S conductive, thereby disabling the power feedback. After the lamp has ignited, it starts to consume power so that the voltage over the first capacitive means drops below a second predetermined value, whereupon the control circuit renders the antiboost switching element S non-conductive thereby once more enabling the power feedback. The known circuit arrangement comprises first and second secondary windings that are part of the preheating means. These first and second secondary windings are magnetically coupled to the inductive means comprised in the load circuit. Both secondary windings are arranged in series with a capacitor and the resulting series arrangements shunt respective electrodes of the lamp. Before the ignition of the lamp the inverter operates at a frequency at which the impedances of the capacitors comprised in the series arrangements are relatively small. As a result a current with a relatively high amplitude flows through the lamp electrodes so that they are heated effectively. After ignition of the lamp the inverter operates at a much lower frequency so that the impedances of the capacitors are relatively high and the lamp electrodes carry a relatively small current. A disadvantage of the known circuit arrangement is that the current that flows through both lamp electrodes during stationary operation, though it is relatively small, continuously dissipates power in the electrodes thereby lowering the efficacy of the circuit arrangement.

SUMMARY OF THE INVENTION

The invention aims to provide a circuit arrangement for operating a discharge lamp that heats at least one of the electrodes of the discharge lamp effectively before lamp ignition and does not dissipate electrode heating power in that electrode during stationary operation.

A circuit arrangement as described in the opening paragraph is therefore according to the invention characterized in that the second circuit comprises a series arrangement of third unidirectional means and the antiboost switching element S and in that during lamp operation a third circuit comprising a series arrangement of the first lamp electrode and the first secondary winding connects a common terminal of the antiboost switching element and the third unidirectional means with terminal N7.

Before ignition of the lamp the control circuit renders the antiboost switching element S conductive. In a circuit arrangement according to the invention, this not only prevents an overvoltage over the first capacitive means by disabling the power feedback, but also allows current to flow in the third circuit. Since the first secondary winding is magnetically coupled to the inductive means comprised in the load circuit, the voltage over the first secondary winding causes an electrode heating current to flow through the series arrangement of the first lamp electrode and the first secondary winding comprised in the third circuit as well as through the antiboost switching element. When after ignition of the lamp the control circuit renders the antiboost switching element S non-conductive, this does not only enable the power feedback but also makes sure that the first secondary winding can no longer cause a current to flow through the series arrangement of the first lamp electrode and the first secondary winding comprised in the third circuit. As a result no electrode heating power is dissipated in the first lamp electrode after the ignition of the lamp, so that the circuit arrangement according to the invention has a relatively high efficacy during stationary operation. The relatively high efficacy of the circuit arrangement according to the invention is achieved using only relatively few additional components since the antiboost switching element S in a circuit arrangement according to the invention thus has two very different functions.

It has been found that the functioning of the circuit arrangement improved in case the second unidirectional means is shunted by a fourth capacitive means. The first capacitive means can be part of the fourth capacitive means.

Preferably, the series arrangement comprised in the third circuit comprises fourth unidirectional means. These fourth unidirectional means separate the preheating means from the inverter means.

Good results have been obtained for a circuit arrangement according to the invention, wherein the series arrangement comprised in the third circuit comprises third capacitive means and a fourth circuit comprising fifth unidirectional means connects a terminal of the third circuit to an anode of the second unidirectional means. The third capacitive means protects the antiboost switching element against a high current in case the first lamp electrode is short circuited. The fifth unidirectional means ensure that during preheat current can flow through the third capacitive means in both directions.

A circuit arrangement according to the invention is very suitable for the operation of more than one lamp at the same time. Satisfying results have been obtained with embodiments of a circuit arrangement according to the invention, wherein the terminals for lamp connection can accomodate at least two lamps and wherein a first lamp electrode of each lamp is part of the third circuit during lamp operation.

The second lamp electrode of a lamp operated by means of a circuit arrangement according to the present invention can be preheated, for instance in case the circuit arrangement further comprises a second secondary winding magnetically coupled to the inductive means comprised in the load circuit and during lamp operation being part of a series arrangement that shunts a second lamp electrode.

A relatively simple and dependable embodiment of the circuit arrangement according to the invention is obtained in case said inverter means comprise a series arrangement of a first switching element, a terminal N1 and a second switching element, said terminal N1 being positioned between the first and second switching element and connected to the load circuit, and a drive circuit DC coupled to the switching elements for generating a drive signal for rendering the switching elements alternately conducting and non-conducting. Preferably the series arrangement of the first and second unidirectional means is shunted by a series arrangement of sixth and seventh unidirectional means and a common terminal N2 of the sixth and seventh unidirectional means is connected to a terminal N6 of the load circuit by means of power feedback means. In this way the circuit arrangement incorporates an extra power feedback. Because of this extra power feedback the circuit arrangement causes relatively little harmonic distortion of the low frequency supply current, while the circuit arrangement is also capable of operating discharge lamps having a relatively high lamp voltage without the drawback of components comprised in the load circuit and the inverter having to conduct a relatively large current during lamp operation.

In a preferred embodiment of a circuit arrangement according to the invention the power feedback means comprises fifth capacitive means. In this way, it is prevented that the power feedback means conduct a DC current. Preferably the circuit arrangement comprises a series arrangement of sixth capacitive means and the fifth capacitive means and connecting terminal N6 to the anode of the second unidirectional means. By dimensioning the capacitive voltage divider formed by the fifth and sixth capacitive means, the amount of power fed back can be adjusted to a value that corresponds to the lowest amount of THD produced by the circuit arrangement.

BRIEF DESCRIPTION OF THE DRAWINGS

Embodiments of the invention will be explained in more detail with reference to a drawing, in which.

DETAILED DESCRIPTION OF THE PREFERRED EMBODIMENTS

Figure 1:
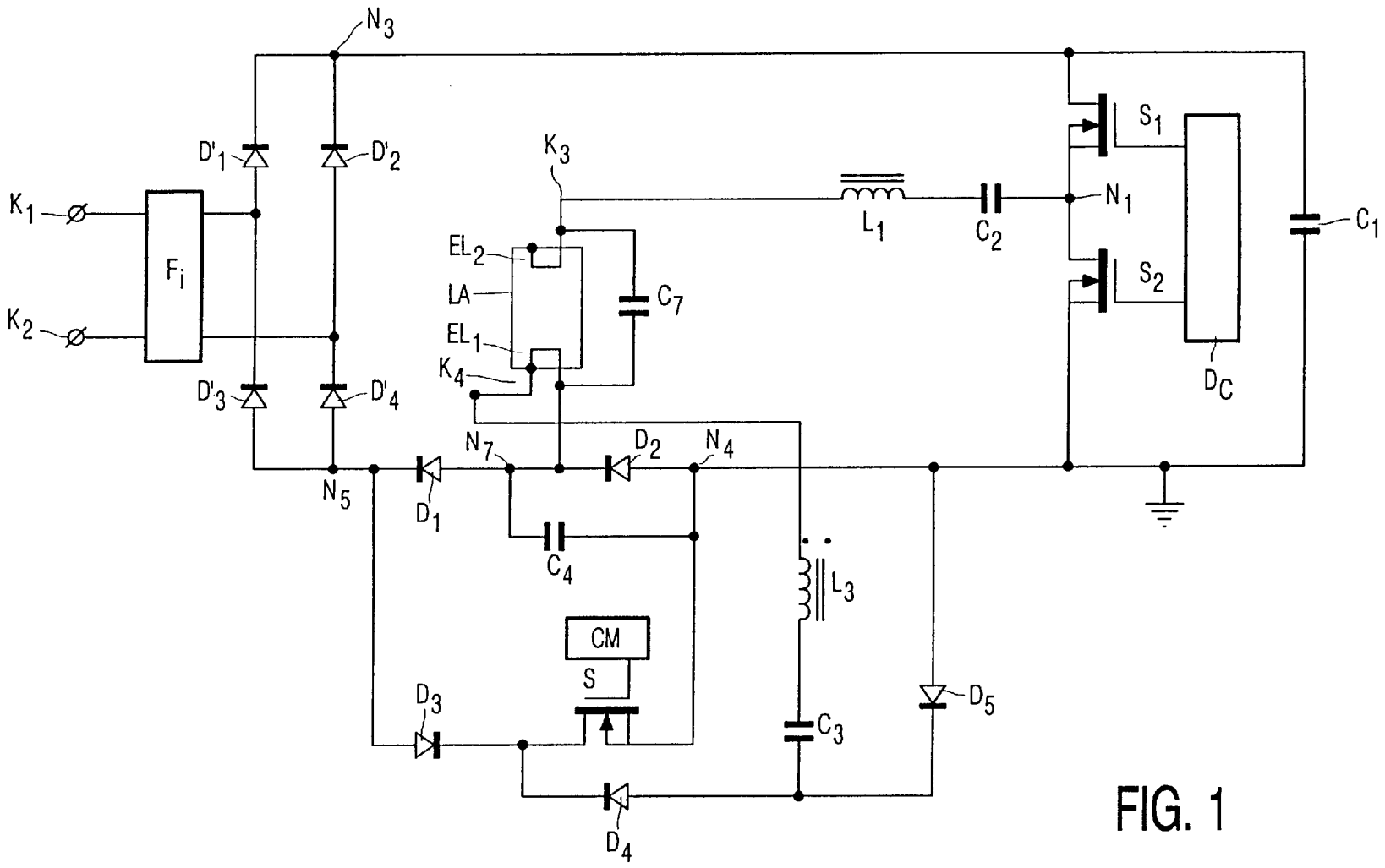
FIG. 1 is a simplified schematic diagram of a first embodiment of a circuit arrangement according to the present invention with a discharge lamp LA connected to the circuit arrangement.

In FIG. 1 K1 and K2 are input terminals for connection to a source of low frequency supply voltage. K1 and K2 are connected to respective input terminals of the filter Fi. Output terminals of filter Fi are coupled to respective input terminals of a rectifier means for rectifying said low frequency supply voltage formed by diodes D'1–D'4. In this embodiment diodes D1 and D2 form first and second unidirectional means respectively. Capacitor C1 forms first capacitive means and forms together with diodes D1 and D2 a first circuit. Switching elements S1 and S2 together with drive circuit DC form inverter means. Drive circuit DC is a circuit part for generating drive signals for rendering switching elements S1 and S2 conducting and non-conducting. Inductor L1, capacitor C2 and terminals K3 and K4 for connecting to a discharge lamp together form a load circuit. In the embodiment shown in FIG. 1 inductor L1 forms inductive means, capacitor C2 forms second capacitive means and terminals K3 and K4 form terminals for lamp connection. Diode D3 and antiboost switching element S together with the control circuit CM form a second circuit. Diode D3 forms third unidirectional means. Diodes D4 and D5 form fourth and fifth unidirectional means. First lamp electrode E11, first secondary winding L3, capacitor C3 and diode D4 form a series arrangement and also the third circuit connecting a common terminal of the antiboost switching element S and diode D3 with terminal N7 between diodes D1 and D2. Capacitor C3 and diode D4 respectively form third capacitive means and fourth unidirectional means. Diode D5 forms a fourth circuit and also fifth unidirectional means.

A first output terminal N3 of the rectifier bridge is connected to a second output terminal N5 of the rectifier bridge by means of a series arrangement of diode D1, diode D2 and capacitor C1. N7 is a common terminal of diode D1 and diode D2. N4 is a common terminal of diode D2 and capacitor C1. Terminal N7 is connected to terminal N4 by means of capacitor C4 forming fourth capacitive means. Capacitor C1 is shunted by a series arrangement of switching elements S1 and S2. A control electrode of switching element S1 is connected to a first output terminal of drive circuit DC. A control electrode of switching element S2 is connected to a second output terminal of drive circuit DC. N1 is a common terminal of switching element S1 and switching element S2. Terminal N1 is connected to terminal N7 by means of a series arrangement of respectively capacitor C2, inductor L1, terminal K3, discharge lamp LA and terminal K4. Discharge lamp LA is shunted by capacitor C7. The series arrangement of diodes D1 and D2 is shunted by a series arrangement of diode D3 and antiboost switching element S. A control electrode of antiboost switching element S is connected to an output of control circuit CM for rendering the antiboost switching element conductive and non-conductive. Terminal N7 is connected to a common terminal of diode D3 and antiboost switch S by means of a series arrangement of respectively the first lamp electrode E11, first secondary winding L3, capacitor C3 and diode D4.

A common terminal of capacitor C3 and diode D4 is connected to terminal N4 by means of diode D5.

The operation of the circuit arrangement shown in FIG. 1 is as follows.

When input terminals K1 and K2 are connected to the poles of a source of a low frequency supply voltage, the rectifier bridge rectifies the low frequency supply voltage supplied by this source so that a DC-voltage is present over capacitor C1 serving as a buffer capacitor. Drive circuit DC renders the switching elements S1 and S2 alternately conducting and non-conducting and as a result a substantially square wave voltage having an amplitude approximately equal to the amplitude of the DC-voltage over capacitor C1 is present at terminal N1. Power feedback is effected via the load circuit and diodes D1 and D2. Before the lamp LA has ignited, it does not consume power so that at this stage of the lamp operation there is an unbalance between the power fed back and the amount of power consumed by the lamp. To prevent the voltage over capacitor C1 to increase to a value that could lead to damage to the circuit arrangement, the control circuit CM renders the antiboost switching element S conductive. The power feedback is thereby disabled and an overvoltage over capacitor C1 is prevented. Since the antiboost switching element S is conductive and an alternating voltage is present over the first secondary winding, an alternating preheat current flows through the first lamp electrode E11 of the lamp LA. During a first half period of the alternating preheat current it flows from a first end of first secondary winding L3 through the first lamp electrode E11, terminal N7, diode D1, diode D3, antiboost switching element S, diode D5 and capacitor C3 to a second end of first secondary winding L3. During a second half-period of the alternating preheat current it flows from the second end of first secondary winding L3 through capacitor C3, diode D4, antiboost switching element S, diode D2, terminal N7 and first lamp electrode E11 back to the first end of first secondary winding L3. At the end of a predetermined preheat period the drive circuit DC changes the frequency at which it renders the switching elements S1 and S2 conductive and non-conductive. The frequency is changed in such a way that the voltage over the lamp LA increases and the lamp LA ignites. Once the lamp has ignited, the control circuit CM renders the antiboost switch S non-conductive. Since both current paths of the alternating preheat current incorporate the antiboost switching element S, they both become non-conductive when, upon ignition of the lamp, the control circuit CM renders the antiboost switch non-conductive. As a result the first lamp electrode does not carry a heating current after the lamp has ignited so that no heating power is dissipated in the first lamp electrode and the efficacy of the circuit arrangement is relatively high.

Figure 2:
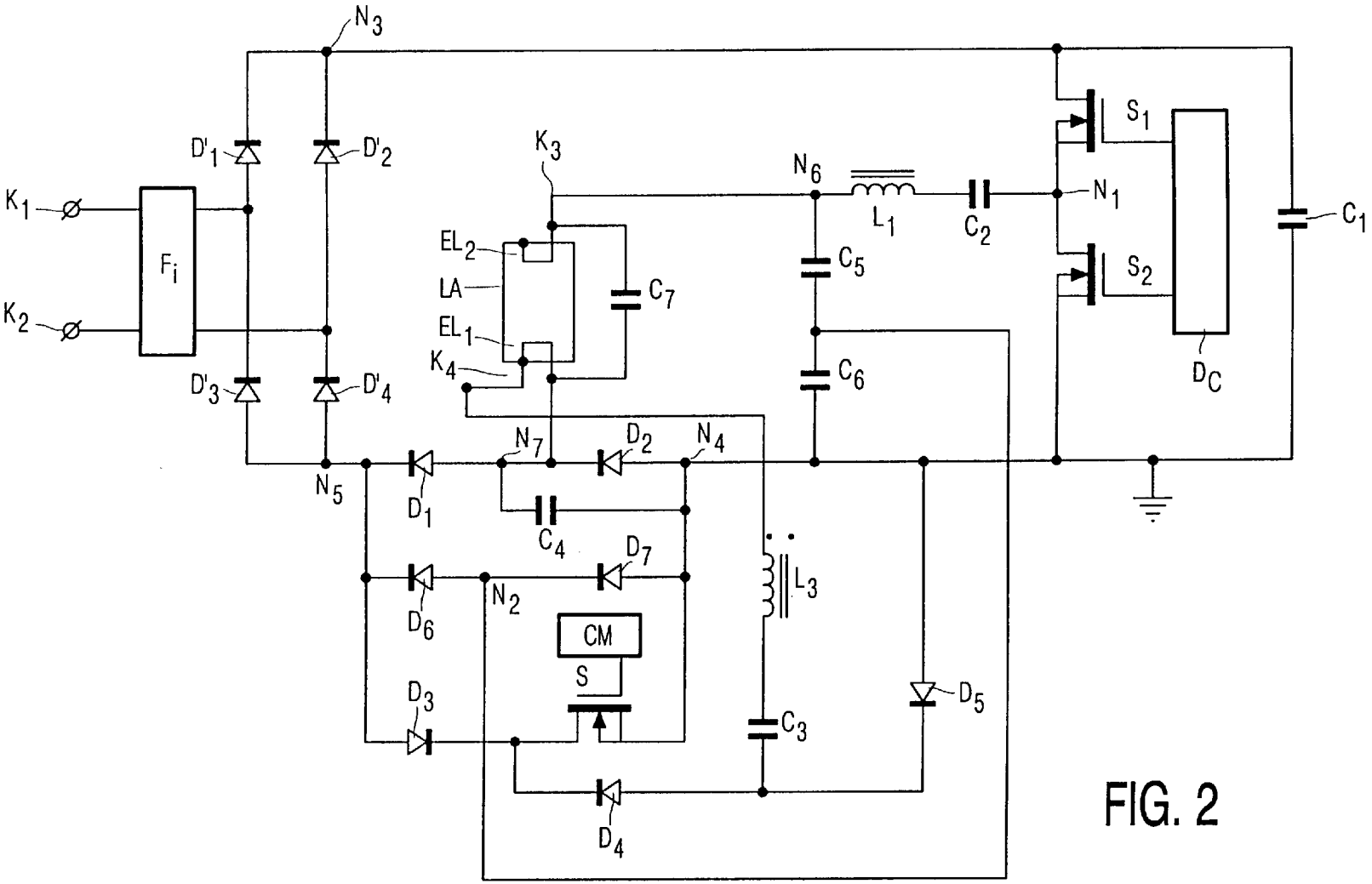
FIG. 2 is a simplified schematic diagram of a second embodiment of a circuit arrangement according to the present invention with a discharge lamp LA connected to the circuit arrangement.

FIG. 2 shows another embodiment of a circuit arrangement according to the invention together with a lamp LA. Those components and circuit parts that are present in both the embodiments of FIG. 1 and FIG. 2 fulfil the same function in both embodiments and are indicated in FIG. 2 by the the same reference numerals as used in FIG. 1. In addition to the components and circuit parts also present in the embodiment shown in FIG. 1, the embodiment shown in FIG. 2 further comprises capacitors C5 and C6 and diodes D6 and D7. Capacitor C5 forms fifth capacitive means and also power feedback means. Capacitor C6 forms sixth capacitive means. Diodes D6 and D7 form sixth and seventh unidirectional means. During operation capacitor C5 and diodes D6 and D7 realize a second power feedback path very similar to the one disclosed in WO 97/19578. Capacitor C6 together with capacitor C5 forms a capacitive voltage divider. The dimensioning of this voltage divider allows the adjustment of the amount of power fed back and therefore the optimization of the amount of THD generated by the circuit arrangement.

A series arrangement of diodes D6 and D7 shunts the series arrangement of diodes D1 and D2. A series arrangement of capacitor C5 and capacitor C6 connects a common terminal N6 of inductor L1 and terminal K3 for lamp connection with terminal N4. A common terminal of capacitor C5 and capacitor C6 is connected to a common terminal N2 of diodes D6 and D7.

Apart from the preheating means, the operation of the circuit arrangement shown in FIG. 2, equipped with a double power feedback is as described in WO 97/19578. The current paths of the preheat current, however, are the same as for the embodiment shown in FIG. 1. Therefore the switching on and off of the preheat current by means of the antiboost switching element S in the embodiment shown in FIG. 2 is also similar to the switching on and off of the preheat current in the embodiment in FIG. 1. For these reasons the operation of the circuit arrangement shown in FIG. 2 will not be described in detail.

Figure 3:
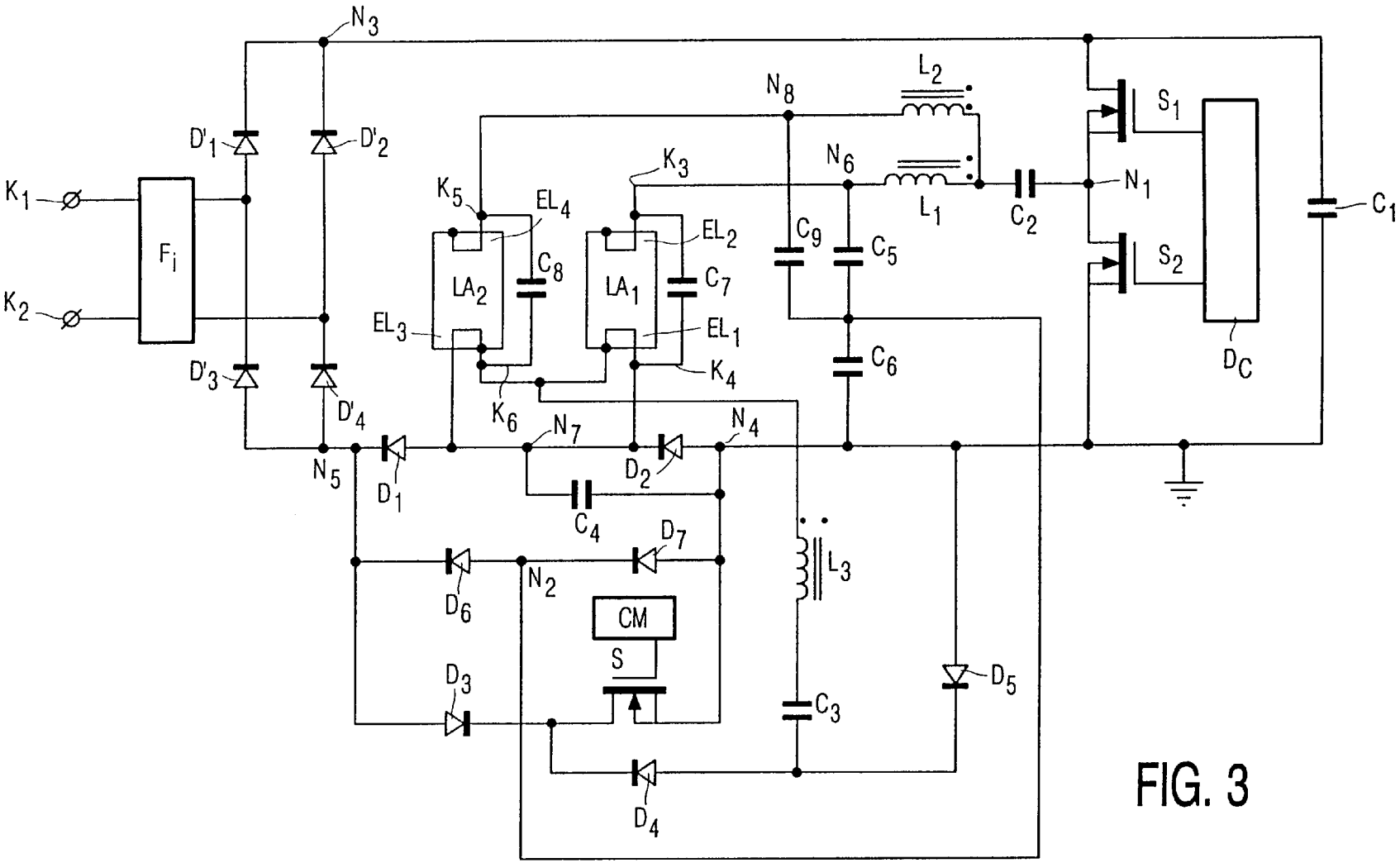
FIG. 3 is a simplified schematic diagram of a third embodiment of a circuit arrangement according to the present invention with discharge lamps LA1 and LA2 connected to the circuit arrangement.

FIG. 3 shows a third embodiment of a circuit arrangement according to the invention together with two lamps, LA1 and LA2. Those components and circuit parts that are also present in the embodiment of FIG. 1 and/or FIG. 2 fulfil the same function in the embodiment shown in FIG. 3 and are indicated in FIG. 3 by the the same reference numerals as used in FIG. 1 and/or FIG. 2. In addition to the components and circuit parts present in the embodiment shown in FIG. 2, the load circuit of the embodiment shown in FIG. 3 further comprises a further inductor L2, further terminals for lamp connection K5 and K6 and capacitors C8 and C9. A common terminal of capacitor C2 and inductor L1 is connected to terminal N7 by means of a series arrangement of inductor L2 and terminals for lamp connection K5 and K6. A lamp LA2, comprising lamp electrodes E13 and E14, is connected to these terminals. The lamp LA2 is shunted by capacitor C8. Capacitor C9 functions as a further power feedback means and connects a common terminal N8 of inductor L2 and terminal K5 to terminal N2. A first end of electrode E11 of lamp LA1 is connected to a first end of electrode E13 of lamp LA2.

The operation of the circuit arrangement shown in FIG. 3 is very similar to the operation of the embodiments shown in FIG. 1 and FIG. 2.

When during preheating the antiboost switching element S is conductive and an alternating voltage is present over the first secondary winding, an alternating preheat current lows through the parallel arrangement of lamp electrode E11 and lamp electrode E13. During a first half period of the alternating preheat current it flows from a first end of first secondary winding L3 through the parallel arrangement of lamp electrode E11 and lamp electrode E13, terminal N7, diode D1, diode D3, antiboost switching element S, diode D5 and capacitor C3 to second end of first secondary winding L3. During a second half-period of the alternating preheat current it flows from the second end of first secondary winding L3 through capacitor C3, diode D4, antiboost switching element S, diode D2, terminal N7 and the parallel arrangement of lamp electrode E11 and lamp electrode E13 back to the first end of first secondary winding L3. Once the lamp had ignited, the control circuit CM renders the antiboost switch S non-conductive. Since both current paths of the alternating preheat current incorporate the antiboost switching element S, they both become non-conductive when, upon ignition of the lamp, the control circuit CM renders the antiboost switch S non-conductive. As a result the first lamp electrodes E11 and E13 do not carry a heating current after the lamp has ignited.

It will be obvious to those skilled in the art that it is possible to install in each of the circuit arrangements shown in FIG. 1, FIG. 2 and FIG. 3 an additional circuit part for preheating the second lamp electrode of the lamp LA, or the second lamp electrodes of the lamps LA1 and LA2 respectively. Such a circuit part could for instance, in case of circuit arrangements that are equipped to operate one lamp, comprise a series arrangement of a second secondary winding and a capacitor shunting the second lamp electrode E12, such as shown in WO 97/19578. In case of circuit arrangements equipped to operate more than one lamp each of the second lamp electrodes could for instance be shunted by a series arrangement of a further secondary winding and a further capacitor. In such a topology of the circuit arrangement the heating current through the second lamp electrode E12, or through second lamp electrodes E12 and E14, would not be interrupted upon ignition of the lamp(s).

We claim:

1. A circuit arrangement for operating a discharge lamp with a high frequency current comprising input terminals for connection to a source of low frequency supply voltage, rectifier means coupled to said input terminals for rectifying said low frequency supply voltage, a first circuit comprising a series arrangement of first unidirectional means, second unidirectional means and first capacitive means, said first circuit being coupled to a first output terminal (N3) of said rectifier means and a second output terminal (N5) of said rectifier means, inverter means coupled to said first capacitive means for generating the high frequency current, a load circuit comprising inductive means, second capacitive means and terminals for lamp connection, said load circuit being coupled to said inverter means and to a terminal (N7) between the first unidirectional means and the second unidirectional means, a second circuit comprising an antiboost switching element (S) and shunting at least one of the first and second unidirectional means, a control electrode of said switching element being coupled to a control circuit for rendering the switching element conductive and non-conductive, preheating means for heating at least one of the electrodes of the discharge lamp comprising a first secondary winding, said first secondary winding during operation being part of a series arrangement shunting said at least one of the electrodes of the discharge lamp and being magnetically coupled to the inductive means comprised in the load circuit, characterized in that the second circuit comprises a series arrangement of third unidirectional means and the antiboost switching element (S) and in that during lamp operation a third circuit comprising a series arrangement of a first lamp electrode and the first secondary winding connects a common terminal of the antiboost switching element and the third unidirectional means with terminal (N7).

2. The circuit arrangement according to claim 1, wherein the series arrangement comprised in the third circuit comprises fourth unidirectional means.

3. The circuit arrangement according to claim 2 wherein the circuit arrangement further comprises a second secondary winding magnetically coupled to the inductive means comprised in the load circuit and during lamp operation being part of a series arrangement that shunts a second lamp electrode.

4. The circuit arrangement according to claim 2, wherein the series arrangement comprised in the third circuit comprises third capacitive means and a fourth circuit comprising fifth unidirectional means connects a terminal of the third circuit to an anode of the second unidirectional means.

5. The circuit arrangement according to claim 4, wherein the terminals for lamp connection accommodate at least two lamps and wherein at least one of the electrodes of each lamp is part of the third circuit during lamp operation.

6. The circuit arrangement according to claim 5 wherein the circuit arrangement further comprises a second secondary winding magnetically coupled to the inductive means comprised in the load circuit and during lamp operation being part of a series arrangement that shunts a second lamp electrode.

7. The circuit arrangement according to claim 4 wherein the circuit arrangement further comprises a second secondary winding magnetically coupled to the inductive means comprised in the load circuit and during lamp operation being part of a series arrangement that shunts a second lamp electrode.

8. The circuit arrangement according to claim 2, wherein the terminals for lamp connection accommodate at least two lamps and wherein at least one of the electrodes of each lamp is part of the third circuit during lamp operation.

9. The circuit arrangement according to claim 1, wherein the series arrangement comprised in the third circuit comprises third capacitive means and a fourth circuit comprising fifth unidirectional means connects a terminal of the third circuit to an anode of the second unidirectional means.

10. The circuit arrangement according to claim 9, wherein the terminals for lamp connection accommodate at least two lamps and wherein at least one of the electrodes of each lamp is part of the third circuit during lamp operation.

11. The circuit arrangement according to claim 10 wherein the circuit arrangement further comprises a second secondary winding magnetically coupled to the inductive means comprised in the load circuit and during lamp operation being part of a series arrangement that shunts a second lamp electrode.

12. The circuit arrangement according to claim 9 wherein the circuit arrangement further comprises a second secondary winding magnetically coupled to the inductive means comprised in the load circuit and during lamp operation being part of a series arrangement that shunts a second lamp electrode.

13. The circuit arrangement according to claim 1, wherein the terminals for lamp connection accommodate at least two lamps and wherein at least one of the electrodes of each lamp is part of the third circuit during lamp operation.

14. The circuit arrangement according to claim 13 wherein the circuit arrangement further comprises a second secondary winding magnetically coupled to the inductive means comprised in the load circuit and during lamp operation being part of a series arrangement that shunts a second lamp electrode.

15. The circuit arrangement according to claim 1 wherein the circuit arrangement further comprises a second secondary winding magnetically coupled to the inductive means comprised in the load circuit and during lamp operation being part of a series arrangement that shunts a second lamp electrode.

16. The circuit arrangement according to claim 1, wherein said inverter means comprises a series arrangement of a first switching element, a terminal (N1) and a second switching element, said terminal (N1) being positioned between the first and second switching elements and connected to the load circuit, and a drive circuit (DC) being coupled to the switching elements for generating a drive signal for rendering the switching elements alternately conducting and non-conducting.

17. The circuit arrangement according to claim 1, wherein the series arrangement of the first and second unidirectional means is shunted by a series arrangement of sixth and seventh unidirectional means and a common terminal (N2) of the sixth and seventh unidirectional means is connected to a terminal (N6) of the load circuit by means of power feedback means.

18. The circuit arrangement according to claim 1, wherein the second unidirectional means is shunted by a fourth capacitive means.

19. The circuit arrangement according to claim 1 wherein a power feedback means comprises fifth capacitive means.

20. The circuit arrangement according to claim 19, wherein the circuit arrangement comprises a series arrangement of sixth capacitive means and the fifth capacitive means and connecting a terminal (N6) to the anode of the second unidirectional means.

* * * * *